US008474730B2

(12) United States Patent
Weaver et al.

(10) Patent No.: US 8,474,730 B2
(45) Date of Patent: Jul. 2, 2013

(54) TRACK SYSTEM INCLUDING A GUARDRAIL

(75) Inventors: Brian Frank Weaver, Burlington, KY (US); Brian Alvin Laws, Cincinnati, OH (US); Robert C. Roberts, Ohatchee, AL (US)

(73) Assignee: Progress Rail Services Corp, Albertville, AL (US)

( * ) Notice: Subject to any disclaimer, the term of this patent is extended or adjusted under 35 U.S.C. 154(b) by 211 days.

(21) Appl. No.: 13/031,678

(22) Filed: Feb. 22, 2011

(65) Prior Publication Data

US 2011/0204153 A1 Aug. 25, 2011

Related U.S. Application Data

(60) Provisional application No. 61/306,942, filed on Feb. 22, 2010.

(51) Int. Cl.
*E01B 5/18* (2006.01)

(52) U.S. Cl.
USPC ..... 238/17; 104/242

(58) Field of Classification Search
USPC ..... 238/17, 20, 21; 104/242, 243
See application file for complete search history.

(56) References Cited

U.S. PATENT DOCUMENTS

| | | | | | |
|---|---|---|---|---|---|
| 1,463,943 | A | * | 8/1923 | Fallon | 238/20 |
| 3,581,989 | A | * | 6/1971 | Pohling | 238/21 |
| 4,061,269 | A | * | 12/1977 | Hixson | 238/17 |
| 4,265,401 | A | * | 5/1981 | Jackson | 238/17 |
| 5,148,980 | A | * | 9/1992 | Fritz et al. | 238/17 |
| 5,176,318 | A | | 1/1993 | Young et al. | |
| 7,467,748 | B2 | | 12/2008 | Weaver et al. | |

* cited by examiner

*Primary Examiner* — S. Joseph Morano
*Assistant Examiner* — Zachary Kuhfuss
(74) *Attorney, Agent, or Firm* — Finnegan, Henderson, Farabow, Garrett & Dunner LLP

(57) ABSTRACT

A track system for a railway system includes a base plate configured to be supported on a railroad tie. The system also includes a drive rail and a guard rail. The drive rail includes a head portion, a web portion, and a base portion. The head portion is configured such that wheels of a train car used in the railway system roll thereon. The web portion connects the head portion and the base portion. The base portion is supported on the base plate. The guardrail includes a head portion, a web portion, and a base portion. The head portion of the guardrail is configured to contact the wheels to prevent the wheels from slipping off the drive rail. The web portion of the guardrail connects the head portion of the guardrail and the base portion of the guardrail. The base portion of the guardrail is retained in a support on the base plate. Cross-sections of each of the head portion of the drive rail and the web portion of the drive rail are substantially the same as cross-sections of the head portion of the guardrail and the web portion of the guardrail, respectively.

17 Claims, 6 Drawing Sheets

TRACK SYSTEM INCLUDING A GUARDRAIL

CROSS-REFERENCE TO RELATED APPLICATION

This application claims the benefit of priority, under 35 USC 119(e), of U.S. provisional application No. 61/306,942, filed Feb. 22, 2010, the disclosure of which is incorporated by reference herein in its entirety.

TECHNICAL FIELD

The disclosure is related to a track system, such as for a railway system, and more particularly to such a track system that includes a drive rail and a guardrail.

BACKGROUND

In a well-known railway system, a locomotive or train travels along two (2) substantially-parallel drive rails. The train may be used to transport goods (e.g., a freight train), or may be used to transport people (e.g., a passenger train), between or among destinations. The train includes one or more motors, which may be powered by diesel fuel and/or electricity, and includes one or more train cars for driving the train and/or for transporting the goods or passengers.

Each train car includes at least two (2) wheels on the left side as well as at least two (2) wheels on the right side thereof. Typically, the train car includes at least four (4) to six (6) wheels on each side. Regardless of the number of wheels on the train car, each wheel includes a flange on its left side as well as a flange on its right side. For each wheel, both the left-side and the right-side flanges extend radially and have a diameter greater than a diameter of a surface of the wheel which contacts and rolls on the drive rail. By this arrangement, contact is maintained between each wheel and the drive rail on which the wheel rolls, because the flanges keep the wheels from slipping off the drive rails. Thus, derailment of the train car is prevented.

Guardrails are disposed along certain portions of the railway system in order to provide additional protection from the train car becoming derailed. For example, when the drive rails define a turn having a radius smaller than a predetermined value, one or more guardrails are placed on the outside of the turn. In particular, the guardrails are disposed about parallel to the drive rail on the outside of the turn, and are spaced apart from the desired and expected path of the wheels. Guardrails are also used along other portions of the railway system, such as where one set of drive rails crosses over another set of drive rails. Thus, in the event that the wheels might otherwise begin to slip off the drive rail, the sides of the wheels will contact the guardrails, and derailment of the train car will be prevented.

U.S. Pat. No. 7,467,748 (the '748 patent) gives an example of a guiderail support assembly that does not use bolts to secure the guiderails to the braces that hold and position the guiderails. Instead, the '748 patent uses a hook device to mount each of the guiderails to the braces. Because the '748 patent does not use bolts to secure the guiderails, disadvantages common to a bolted system are avoided. For example, in a bolted system, the precise locations of the bolt holes in the braces must be measured. Then, corresponding bolt holes must be machined or otherwise formed in the guardrails, when the replacement guardrails are being custom manufactured for bolted-installation on the braces. Thus, guardrail replacement in the '748 patent can be accomplished more quickly and less expensively, and with less tooling, because custom bolt-hole patterns are not required to be formed in the replacement guardrails.

The '748 patent suffers from its own disadvantages, however. For example, the guardrails must have a specialized cross-section to fit the specific geometry of the braces disclosed in the '748 patent. Throughout the world, the number of guardrails that are manufactured is far fewer than the number of drive rails produced. Thus, manufacture of the guardrails, such as through forging the specialized cross-section, is relatively expensive per unit as compared to the manufacture of the drive rails, which are a standard component of the railway system and are used in much greater quantity.

SUMMARY

The present disclosure is directed to a track system for a railway system that includes a base plate configured to be supported on a railroad tie. The system also includes a drive rail and a guiderail. The drive rail includes a head portion, a web portion, and a base portion. The head portion is configured such that wheels of a train car used in the railway system roll thereon. The web portion connects the head portion and the base portion. The base portion is supported on the base plate. The guardrail includes a head portion, a web portion, and a base portion. The head portion of the guardrail is configured to contact the wheels to prevent the wheels from slipping off the drive rail. The web portion of the guardrail connects the head portion of the guardrail and the base portion of the guardrail. The base portion is retained in a support on the base plate. Cross-sections of each of the head portion of the drive rail and the web portion of the drive rail are substantially the same as cross-sections of the head portion of the guardrail and the web portion of the guardrail, respectively.

The present disclosure is further directed to a method of providing a track system for a railway system. The method includes disposing a first standard rail as a drive rail on which wheels of a train car used in the railway system are configured to roll, and disposing a second standard rail as a guardrail that is configured to contact the wheels to prevent the wheels from slipping off the drive rail.

The present disclosure is still further directed to a railway track system that includes a base plate and a guardrail. The guardrail includes a head portion, a web portion, and a base portion. The head portion of the guardrail is configured to contact wheels of a train car, which roll on a drive rail, to prevent the wheels from slipping off the drive rail. The web portion of the guardrail connects the head portion of the guardrail and the base portion of the guardrail. The base portion of the guardrail is retained in a support connected to the base plate. Cross-sections of the head portion of the guardrail and the web portion of the guardrail are substantially the same as cross-sections of each of a head portion of the drive rail and a web portion of the drive rail, respectively.

The present disclosure is still further directed to a railway track system that includes first and second drive rails, and a guardrail. The first drive rail is configured to support wheels of a train car which roll thereon. The second drive rail includes a head portion, a web portion, and a base portion. The head portion is configured to support the wheels of the train car which roll thereon. The web portion connects the head portion and the base portion. The guardrail includes a head portion, a web portion, and a base portion. The head portion of the guardrail is configured to contact the wheels to prevent the wheels from slipping off either of the first drive rail or the second drive rail. The web portion of the guardrail connects the head portion of the guardrail and the base portion of the guardrail. The base portion is retained in a support. Cross-sections of each of the head portion of the second drive rail and the web portion of the second drive rail are substantially the same as cross-sections of the head portion of the guardrail and the web portion of the guardrail, respectively.

DETAILED DESCRIPTION

Figure 1:
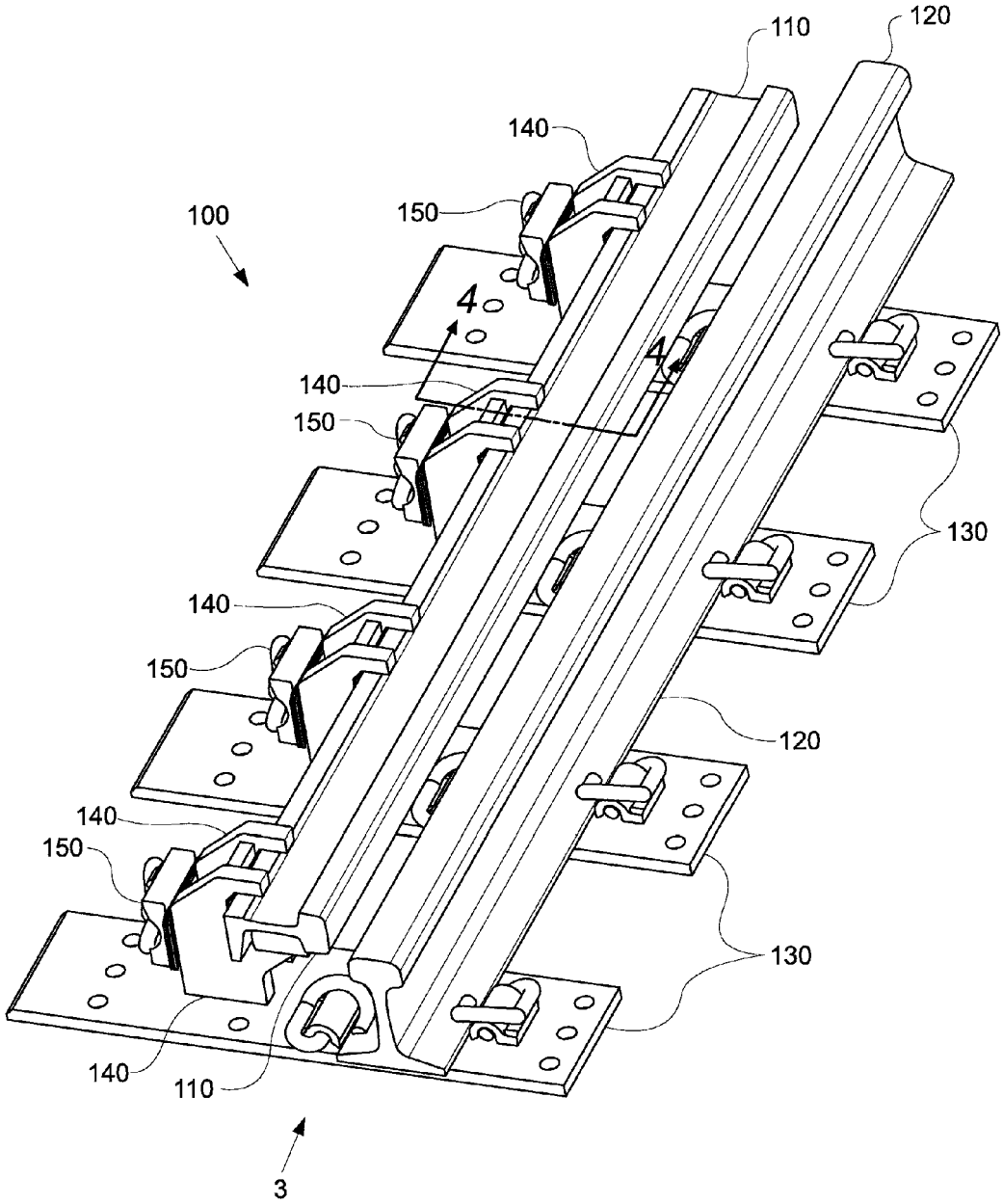
FIG. 1 is an isometric top view of the track system in accordance with the disclosure.
Figure 2:
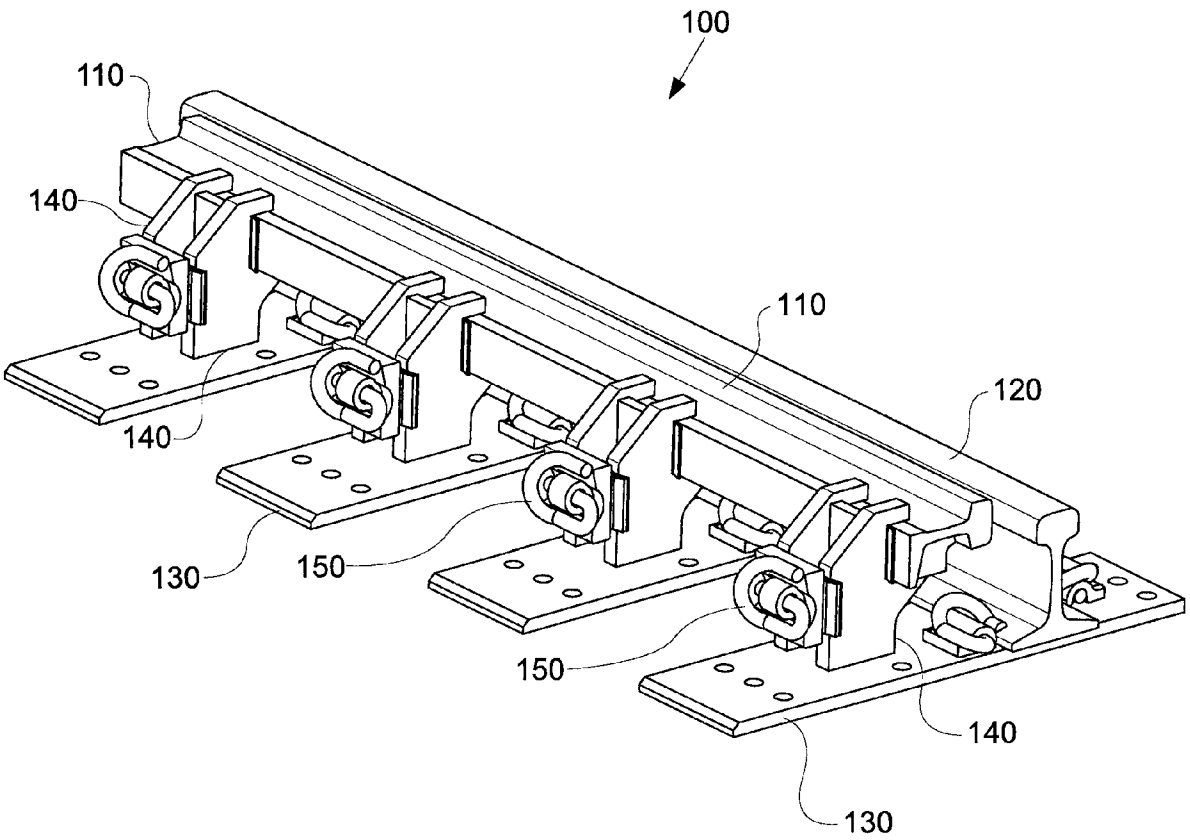
FIG. 2 is an isometric side view of the track system.
Figure 3:
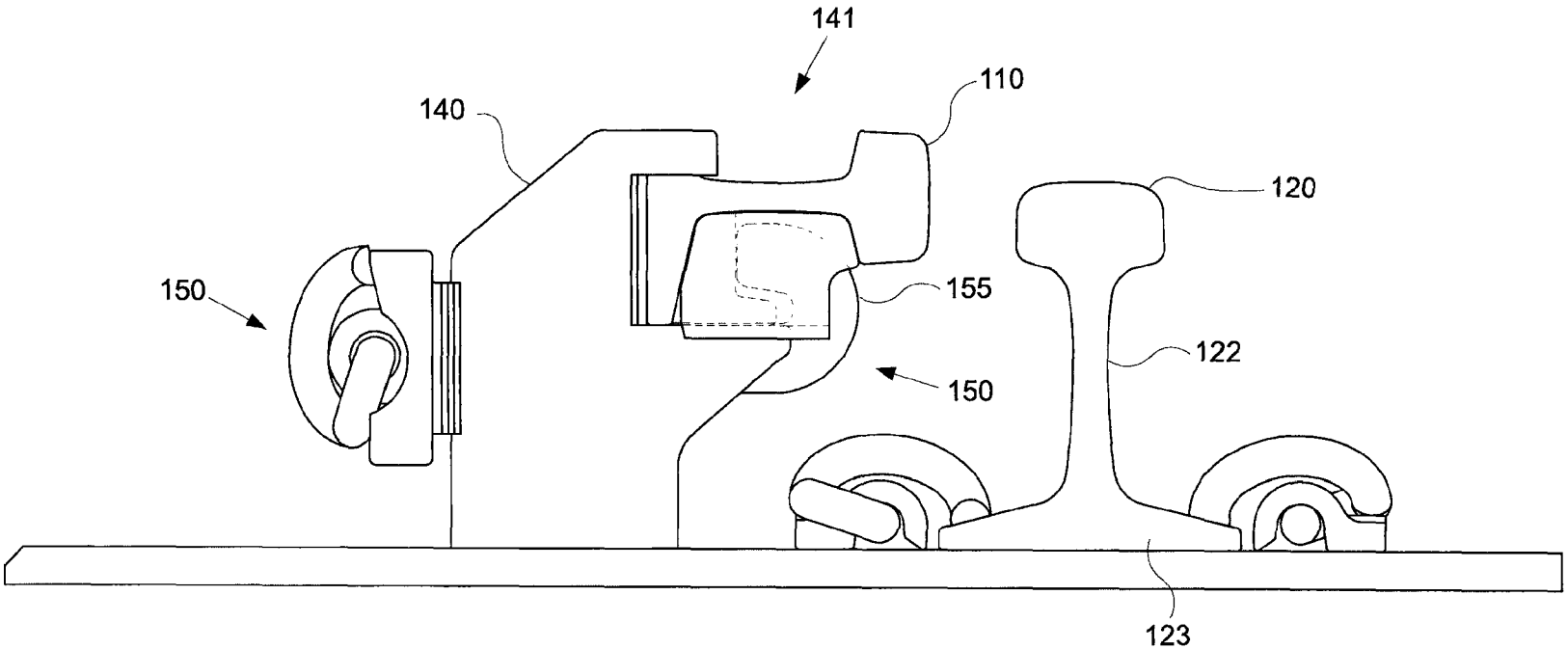
FIG. 3 is a view of the track system taken along the direction of arrow 3 in FIG. 1.

FIGS. 1-6 illustrate non-limiting examples of the track system as well as its associated components, which may be used in a railway system, in accordance with the disclosure. Broadly, the track system 100 may include a guardrail 110 and a drive rail 120, each of which is described in further detail below. The drive rail 120 may be a standard drive rail, and the guardrail 110 may be formed from a drive rail that is substantially the same as the drive rail 120, such that the guardrail 110 is also formed from a standard drive rail. It is to be understood that although the drive rail 120 and the guardrail 110 may share a similar appearance, overall sizes and dimensions may vary widely between these rails.

The drawings show the track system 100 that includes only one (1) drive rail 120. It is to be understood, however, that the track system 100 may include or be used in conjunction with a second drive rail that is disposed parallel to the drive rail 120, and that the second drive rail also may be a standard drive rail that is substantially the same as the drive rail 120. The track system 100 may be used in a railway system in which a locomotive or train travels along the two (2) drive rails. The train may be used to transport goods (e.g., a freight train), or may be used to transport people (e.g., a passenger train), between or among destinations. The train may include one or more motors, powered by diesel fuel and/or electricity, and may include one or more train cars for driving the train and/or for transporting the goods or passengers. Further, each train car may include at least two (2) wheels on the left side and at least two (2) wheels on the right side thereof. Each wheel may include a flange on its left side and on its right side, which may extend radially and may have a diameter greater than a diameter of a surface of the wheel which contacts and rolls on the drive rail 120. Although not shown in the drawings, it is understood that the drive rail 120 may be connected to railroad ties or sleepers, with ballast disposed between the ties to stabilize components of the track system 100.

As shown in the figures, base plates 130 may be connected to the drive rail 120. The base plates 130 may be connected to the ties, such as by driving spikes or disposing other fasteners through the holes that are formed on the outer perimeters of the base plates 130. The connections between the base plates 130 and the drive rail 120 or between the base plates 130 and the ties may be either direct (e.g., without any component disposed therebetween) or indirect (e.g., with one or more components disposed therebetween).

As shown in the drawings, the drive rail 120 of the track system 100 may include a head portion 121, a web portion 122, and a base portion 123. The head portion 121 may maintain contact with the surfaces of the wheels which contact and roll on the drive rail 120. The base portion 123 may contact and connect to the base plates 130, either directly or indirectly. The web portion 122 may connect the head portion 121 to the base portion 123. The drive rail 120 may be a standard drive rail, and may be in common use as a drive rail for locomotives in railway systems throughout the United States and/or throughout other areas of the world. The drive rail 120 may have an about modified I-beam shape, and may exhibit planar symmetry along a length thereof. As shown in the drawings, the drive rail 120 may be connected to the base plates 130 such as by using spring clips on both sides of the drive rail 120. It is to be understood, however, that the drive rail 120 may be connected to the base plates 130 through the use of another type of fastener. The drive rail 120 may be either directly or indirectly disposed on top of the base plates 130.

Brace plates 140 may act as a support for the guardrail 110, which establishes or maintains the position of the guardrail 110, such as the position of the guardrail 110 relative to the drive rail 120. As shown in the drawings, two (2) brace plates 140 may be connected to each base plate 130. It is to be understood, however, that more or fewer brace plates 140 may be connected to each base plate 130, and/or that different numbers of brace plates 140 may be connected to different ones of the base plates 130. Each of the brace plates 140 may define surfaces on which the guardrail 110 is to be disposed, and/or the pair of brace plates 140 may define or otherwise form openings 141 that are sized, shaped, oriented, and/or otherwise configured to receive and retain the guardrail 110 therein. The brace plates 140 may be connected to the base plate 130 by a variety of manufacturing or fastening processes, such as by welding the brace plates 140 to the base plate 130, or by forming the base plate 130 and brace plates 140 integral with one another.

Figure 5:
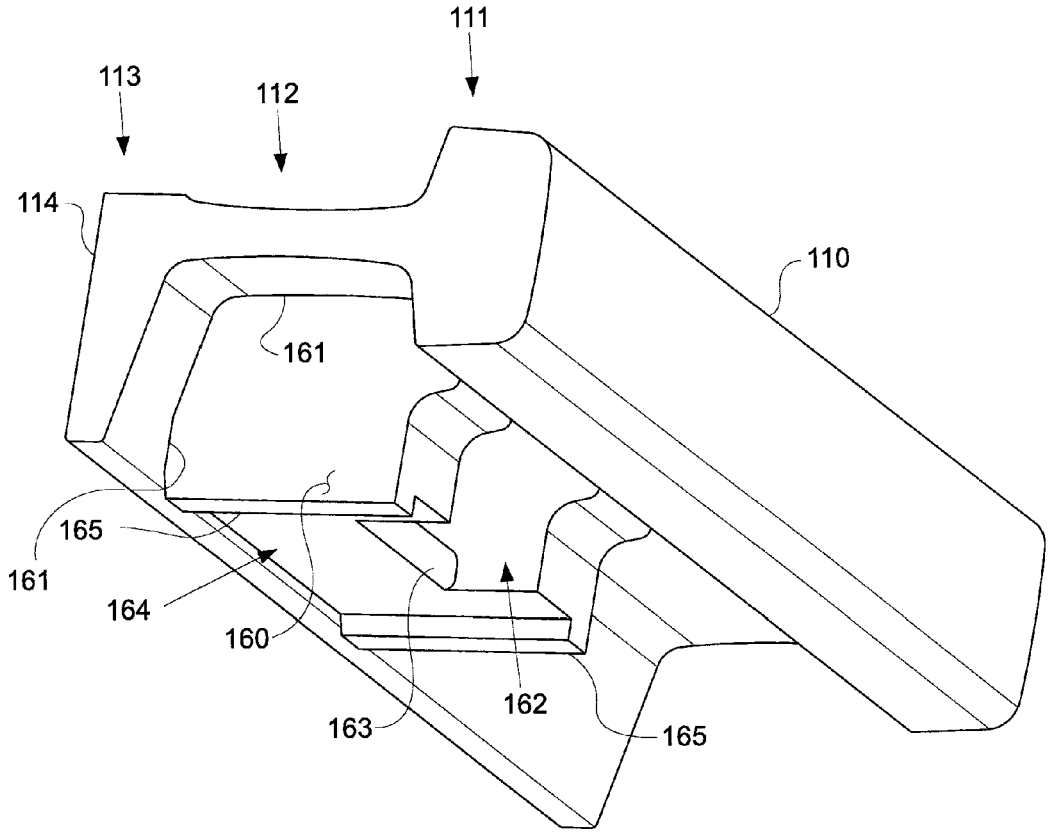
FIG. 5 is a detailed view of a section of the guardrail, as well as of the wedge block, of the track system.
Figure 6:
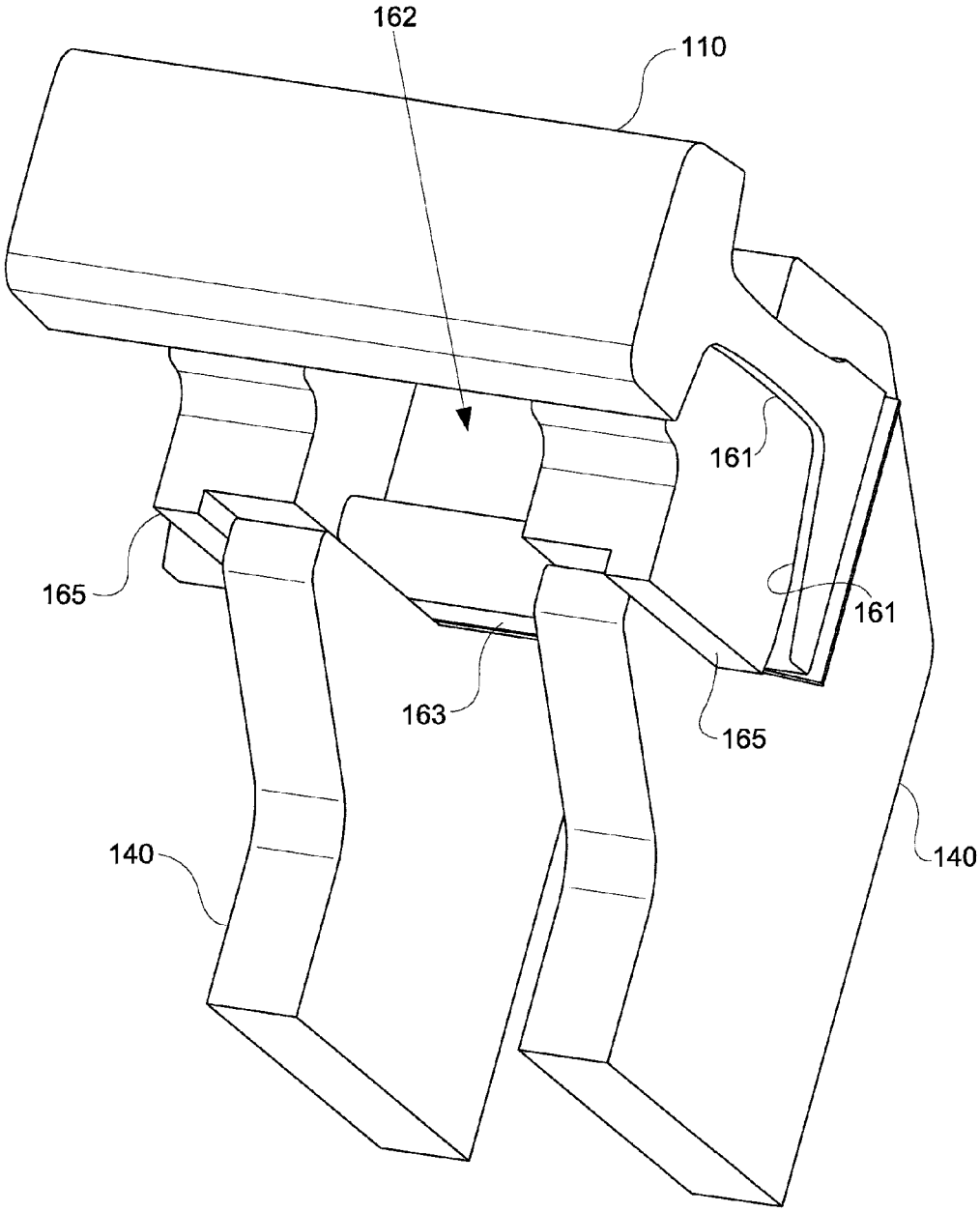
FIG. 6 is a detailed view of a section of the guardrail, as well as of the wedge block and the brace plates, of the track system.

Wedge blocks 160 may be used to connect the guardrail 110 to the brace plates 140, such as within the openings 141 defined by the brace plates 140. FIGS. 5 and 6 show details of one of the wedge blocks 160. As shown in the figures, the wedge block 160 may include a guardrail-contacting portion 161 that is sized, shaped, oriented, and/or otherwise configured to prevent undesired movement of the guardrail 110 relative to the brace plates 140 when the track system 100 is assembled, thereby also preventing undesired movement of the guardrail 110 relative to the drive rail 120. Although the figures show the guardrail-contacting portion 161 having a shape corresponding to that of the guardrail 110, it is to be understood that the guardrail-contacting portion 161 may have other shapes, for example such that the guardrail-contacting portion 161 only contacts the guardrail 110 at some number of points.

The wedge block 160 may further define a fastener void 162, which is sized, shaped, oriented, and/or otherwise configured to receive a fastener assembly (described in further detail below). A lip 163 may also be formed or otherwise defined by the wedge block 160, with the lip 163 being sized, shaped, oriented, and/or otherwise configured to retain the fastener assembly in the fastener void 162. Sides 165 of the wedge block 160 may be used to define a slot 164 that is sized, shaped, oriented, and/or otherwise configured so that the wedge block 160 may be secured to the two (2) brace plates 140. Specifically, as shown in the drawings, the wedge block 160 may span the two (2) brace plates 140, such that multiple surfaces of the wedge block 160 contact multiple surfaces of each of the two (2) brace plates 140, and such that the brace plates 140 are disposed between and substantially in contact with the sides 165 of the wedge block 160.

Figure 4:
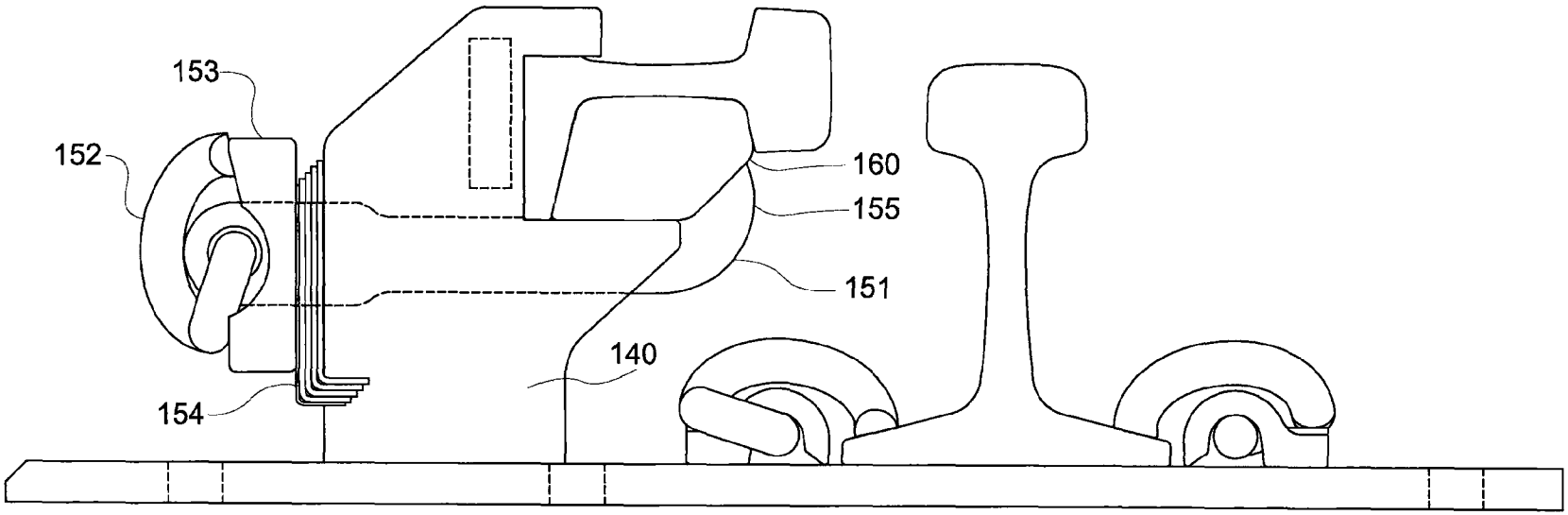
FIG. 4 is a cross-sectional view of the track system taken along arrows 4-4 in FIG. 1.

As mentioned above, fasteners assemblies 150 may be used to retain the wedge blocks 160 against the guardrail 110, when the wedge blocks 160 and the guardrail 110 are disposed on the brace plates 140. As shown in the drawings, each of the fastener assemblies 150 may include a fastener 151, details of which are shown in FIG. 4, which terminates on one end thereof in a tip 155 that is received and retained in the wedge block 160. The tip 155 may have a generally C-shape. The fastener 151 may extend between the brace plates 140, such that the tip 155 of the fastener 151 is disposed over the lip 163 of the wedge block 160 and is also disposed within the fastener void 162. An opposite end of the fastener 151 may include a hole, through which a portion of a spring clip 152 is disposed. By this arrangement, opening of the spring clip 152 may permit the fastener assembly 150 to be removed from the track system 100, such that the wedge block 160 and the guardrail 110 can be removed from the brace plate 140. Conversely, closing of the spring clip 152 may prevent the fastener assembly 150 from being removed from the track system 100, such that the wedge block 160 presses against the guardrail 110, which presses against the brace plates 140, so that none of the fastener assembly 150, the wedge block 160, and the guardrail 110 is removable from the track system 100. The fastener assembly 150 may include a spacer 153 disposed between the spring clip 152 and the brace plates 140 to thereby provide a surface against which the spring clip 152 may rest when the spring clip 152 is closed. One or more shims 154 may be disposed between the spacer 153 and the brace plates 140. By using more or fewer shims 154 in a known manner, the force that the fasteners assembly 150 exerts against the wedge block 160, and thus the force by which the guardrail 110 is held in the brace plates 140, may be adjusted or varied. The shims 154 may be disposed between guardrail 110 and the brace plates 140, to thereby compensate for wear on the guardrail 110 caused by the wheels of the train cars.

As shown in the figures, and in particular in FIG. 5, the guardrail 110 may include a head portion 111, a web portion 112, and a base portion 113. The head portion 111 may be sufficiently spaced apart from the drive rail 120, such that the head portion 111 contacts the side of any of the wheels that roll on the drive rail 120 to prevent each wheel from sliding off the drive rail 120 toward the guardrail 110. By this arrangement, the guardrail 110 may prevent slipping of the wheels off the drive rail 120, and may prevent derailment of the rail car on which the wheels are disposed. The base portion 113 may be disposed within the opening 141 formed by the brace plates 140, and may contact the brace plates 140. Specifically, an at least about flat bottom surface 114 of the base portion 113 may contact corresponding surfaces of the brace plates 140. The web portion 112 of the guardrail 110 may connect the head portion 111 to the base portion 113.

The guardrail 110 may be formed from a standard drive rail that may be in common use as a drive rail for locomotives in railway systems throughout the United States and/or other areas of the world. By way of specific example, the guardrail 110 may be formed from a rail that is substantially the same as the drive rail 120. Thus, the guardrail 110 may have an about modified I-beam shape, and may exhibit planar symmetry along a length thereof except with respect to the base portion 113. With the rail substantially similar to the drive rail 120 being referred to as drive rail 120 here, the guardrail 110 may be formed by removing a part of the base portion 123 of the drive rail 120, such as by cutting the base portion 123 off the drive rail 120.

Thus, the cross-sections of the head and web portions of the drive rail 120 are substantially the same as those of the corresponding head and web portions of the guardrail 110. Further, the cross-section of the remaining part of the base portion of the guardrail 110 is substantially the same as the corresponding part of the base portion of the drive rail 120.

Although not shown in the drawings, to form the guardrail 110 another portion of the drive rail 120 may be removed, multiple portions of the drive rail 120 may be removed, or no portion of the drive rail 120 may be removed. In such instances, other components of the track system 100 may be sized, shaped, oriented, and/or otherwise configured such that the drive rail 120 may be used as, or to form, the guardrail 110. By way of specific non-limiting example, the geometry of the brace plates 140 and/or the wedge blocks 160 may be changed so that a differently-modified or unmodified drive rail 120 may be used as the guardrail 110.

One or more shims may be disposed within the track system 100, to thereby allow adjustment of the position of the guardrail 110 relative to the drive rail 120. The use of shims may permit the size of a gap between the head portion 121 of the drive rail 120 and the head portion 111 of the guardrail 110 to be adjusted. For example, as shown in the drawings, the shims may be disposed between the brace plates 140 and the surface 114 of the guardrail 110. It is to be understood, however, that disposing the shims in other locations throughout the track system 100 is not outside of the scope of this disclosure, so long as the addition or removal of these shims may permit the guardrail 110 to be repositioned relative to other components of the track system 100. The position of the guardrail 110 relative to the drive rail 120 may be adjusted during installation of the guardrail 110, and/or after extended use of the guardrail 110. For example, the head portion 111 of the guardrail 110 may become worn after the guardrail 110 rubs against the wheels of the train cars rolling on the drive rail 120. The use of additional shims, for example, may move the head portion 111 closer to the drive rail 120, thereby reestablishing the gap of an acceptable size between the guardrail 110 and the drive rail 120.

INDUSTRIAL APPLICABILITY

Consistent with the disclosure, the track system 100 may include the drive rail 120 that is a standard drive rail, which is in common use as a drive rail for locomotives in railway systems throughout the United States and/or throughout other areas of the world. Thus, the drive rail 120 may be produced in extremely large quantities. The track system 100 may also include the guardrail 110, which may be formed from one of these standard drive rails. In accordance with the disclosure, the guardrail 110 may be formed by removing a specific portion of the standard drive rail. Thus, for example, the guardrail 110 may be formed by removing a part of the base portion 123 of another drive rail 120, such as by cutting the base portion 123 off the drive rail 120. Alternatively, but still in accordance with the disclosure, another portion of the drive rail 120 may be removed, multiple portions of the drive rail 120 may be removed, or no portion of the drive rail 120 may be removed, to form the guardrail 110. Therefore, it is understood that broadly the current disclosure is directed to the track system 100 that includes the drive rail 120, which is a standard drive rail, and the guardrail 110, which is formed from another one of the standard drive rails.

By forming the guardrail 110 from a drive rail that is substantially similar to the drive rail 120, numerous advantages may be achieved. For example, the guardrail 110 need not be specially forged. Thus, the cost per unit for the guardrail 110 is the same or nearly the same as the drive rail 120. Further, those installing, maintaining, or repairing railway systems need not keep a separate stock of the guardrails 110. Rather, only the drive rails 120 need be available and kept in stock, for repair or replacement of either the drive rails 120 or the guardrails 110. Thus, repair and replacement of components of the railway system is greatly simplified and reduced in cost, as compared to other known and prior art systems.

It will be apparent to those skilled in the art that various modifications and variations may be made to the track system without departing from the scope of the disclosure. Other embodiments of the disclosed track system will be apparent to those skilled in the art from consideration of the specification and practice of the track system disclosed herein. It is intended that the specification and examples be considered as exemplary only, with a true scope of the disclosure being indicated by the following claims and their equivalents.

What is claimed is:

1. A track system for a railway system, comprising:

a base plate configured to be supported on a railroad tie;

a drive rail comprising a head portion, a web portion, and a base portion, the head portion configured such that wheels of a train car used in the railway system roll thereon, the web portion connecting the head portion and the base portion, and the base portion being supported on the base plate; and a guardrail comprising a head portion, a web portion, and a base portion, the head portion of the guardrail configured to contact the wheels to prevent the wheels from slipping off the drive rail, the web portion of the guardrail connecting the head portion of the guardrail and the base portion of the guardrail, and the base portion of the guardrail being retained in a support on the base plate;

two brace plates connected to the base plate, the two brace plates supporting the guardrail in an opening defined by the two brace plates;

a wedge block contacting both the web portion of the guardrail and the base portion of the guardrail, such that the guardrail is disposed between the wedge block and the two brace plates; and a fastener assembly fastening the wedge block to the two brace plates.

2. The track system according to claim 1, wherein the base portion of the drive rail comprises first and second parts, and the base portion of the guardrail comprises a first part having a cross-section substantially the same as a cross-section of the first part of the drive rail.

3. The track system according to claim 2, wherein the base portion of the guardrail consists only of the first part of the base portion of the guardrail.

4. The track system according to claim 1, wherein the base portion of the drive rail comprises first and second parts, and the base portion of the guardrail comprises a first part having a cross-section substantially the same as a cross-section of the first part of the drive rail.

5. The track system according to claim 1, wherein the fastener assembly comprises a fastener having a substantially C-shaped tip, and the wedge block comprises a fastener void configured to receive the C-shaped tip.

6. The track system according to claim 1, wherein cross-sections of each of the head portion of the drive rail and the web portion of the drive rail are substantially the same as cross-sections of the head portion of the guardrail and the web portion of the guardrail, respectively.

7. A method of providing a track system for a railway system, the method comprising:

disposing a first standard rail as a drive rail on which wheels of a train car used in the railway system are configured to roll; and disposing a second modified standard rail as a guardrail that is configured to contact the wheels to prevent the wheels from slipping off the drive rail;

supporting the guardrail with two brace plates, the two brace plates forming an opening in which the guardrail is received;

holding the guardrail against the two brace plates with a wedge block that is connected to the two brace plates by a fastener assembly.

8. The method according to claim 7, wherein the modification of the second standard rail includes removing a part of the second standard rail.

9. The method according to claim 7, wherein the modification of the second standard rail includes removing a part of a base portion of the second standard rail.

10. The method according to claim 7, wherein the drive rail comprises a head portion, a web portion, and a base portion, the head portion configured such that the wheels roll thereon, the web portion connecting the head portion and the base portion, and the base portion being supported on a base plate that is connected to a railroad tie, wherein the guardrail comprises a head portion, a web portion, and a base portion, the head portion of the guardrail configured to contact the wheels to prevent the wheels from slipping off the drive rail, the web portion of the guardrail connecting the head portion of the guardrail and the base portion of the guardrail, and the base portion of the guardrail being retained in a support connected to the base plate, and wherein cross-sections of each of the head portion of the drive rail and the web portion of the drive rail are substantially the same as cross-sections of the head portion of the guardrail and the web portion of the guardrail, respectively.

11. The method according to claim 10, wherein the fastener assembly comprises a fastener having a substantially C-shaped tip, and the wedge block comprises a fastener void configured to receive the C-shaped tip.

12. The method according to claim 7, wherein the first and second standard rails have corresponding portions with substantially similar cross-sections.

13. A railway track system, comprising:

a base plate;

a guardrail comprising a head portion, a web portion, and a base portion, the head portion of the guardrail configured to contact wheels of a train car, which roll on a drive rail, to prevent the wheels from slipping off the drive rail, the web portion of the guardrail connecting the head portion of the guardrail and the base portion of the guardrail, and the base portion of the guardrail being retained in a support connected to the base plate;

two brace plates connected to the base plate, the two brace plates supporting the guardrail in an opening defined by the two brace plates:

a wedge block contacting both the web portion of the guardrail and the base portion of the guardrail, such that the guardrail is disposed between the wedge block and the two brace plates; and a fastener assembly fastening the wedge block to the two brace plates.

14. The railway track system according to claim 13, wherein the cross-sections of the head portion of the guardrail and the web portion of the guardrail are substantially the same as cross-sections of each of a head portion of a second drive rail and a web portion of a second drive rail, respectively.

15. The railway track system according to claim 13, wherein the base portion of the guardrail comprises a first part having a cross-section substantially the same as a cross-section of a corresponding first part of the drive rail.

16. The railway track system according to claim 13, wherein the fastener assembly comprises a fastener having a substantially C-shaped tip, and the wedge block comprises a fastener void configured to receive the C-shaped tip.

17. The railway track system according to claim 13, wherein cross-sections of the head portion of the guardrail and the web portion of the guardrail are substantially the same as cross-sections of each of a head portion of the drive rail and a web portion of the drive rail, respectively.

* * * * *